US009157036B2

(12) United States Patent
Shih

(10) Patent No.: US 9,157,036 B2
(45) Date of Patent: Oct. 13, 2015

(54) HYDROPROCESSING OF GAS OIL BOILING RANGE FEEDS

(75) Inventor: Stuart S. Shih, Gainesville, VA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 811 days.

(21) Appl. No.: 13/076,682

(22) Filed: Mar. 31, 2011

(65) Prior Publication Data

US 2011/0240521 A1 Oct. 6, 2011

Related U.S. Application Data

(60) Provisional application No. 61/341,453, filed on Mar. 31, 2010.

(51) Int. Cl.

| | |
|---|---|
| ***C10G 67/02*** | (2006.01) |
| ***C10G 65/04*** | (2006.01) |
| ***C10G 45/08*** | (2006.01) |
| ***C10G 45/64*** | (2006.01) |
| ***C10G 47/18*** | (2006.01) |

(52) U.S. Cl.

CPC ..... *C10G 65/043* (2013.01); *C10G 45/08* (2013.01); *C10G 45/64* (2013.01); *C10G 47/18* (2013.01); *C10G 65/04* (2013.01); *C10G 2300/1055* (2013.01); *C10G 2300/202* (2013.01); *C10G 2300/301* (2013.01); *C10G 2300/304* (2013.01); *C10G 2300/4018* (2013.01); *C10G 2400/04* (2013.01); *C10G 2400/08* (2013.01)

(58) Field of Classification Search

CPC ..... C10G 45/08; C10G 45/64; C10G 47/18; C10G 65/04; C10G 65/043; C10G 2300/1055; C10G 2300/202; C10G 2300/301; C10G 2300/302; C10G 2300/304; C10G 2300/4018; C10G 2400/04; C10G 2400/08

USPC ..... 208/89, 58, 212

See application file for complete search history.

(56) References Cited

U.S. PATENT DOCUMENTS

| | | | | |
|---|---|---|---|---|
| 4,486,296 | A * | 12/1984 | Oleck et al. | 208/111.15 |
| 4,518,485 | A | 5/1985 | LaPierre et al. | |
| 4,695,365 | A * | 9/1987 | Ackelson et al. | 208/89 |
| 4,788,378 | A | 11/1988 | Chang et al. | |
| 6,261,441 | B1 * | 7/2001 | Gentry et al. | 208/58 |
| 6,447,671 | B1 | 9/2002 | Morel et al. | |
| 2004/0050753 | A1 * | 3/2004 | Marion et al. | 208/89 |
| 2005/0040073 | A1 * | 2/2005 | Cody et al. | 208/89 |
| 2005/0090700 | A1 * | 4/2005 | Clark | 585/1 |

FOREIGN PATENT DOCUMENTS

| | | |
|---|---|---|
| EP | 2154225 | 2/2010 |
| WO | 03070857 | 8/2003 |
| WO | 2005047431 | 5/2005 |

* cited by examiner

*Primary Examiner* — Prem C Singh
*Assistant Examiner* — Brandi M Doyle
(74) *Attorney, Agent, or Firm* — Robert A. Migliorini; David M. Weisberg; Larry E. Carter

(57) ABSTRACT

A system and method for producing fuels and lubricant basestocks from gas oil boiling range feeds is provided. Desulfurization and conversion stages are used to form fuel and lubricant products. The product from a desulfurization stage can be fractionated, and a portion of the fractionated bottoms can be used as an input feed for a conversion or hydrocracking stage. The configuration can advantageously allow for reduced amounts of catalyst in the conversion stage.

15 Claims, 4 Drawing Sheets

HYDROPROCESSING OF GAS OIL BOILING RANGE FEEDS

CROSS-REFERENCE TO RELATED APPLICATIONS

This application claims the benefit of Provisional U.S. Application No. 61/341,453, filed on Mar. 31, 2010, the contents of which are hereby incorporated by reference herein.

FIELD OF THE INVENTION

This invention relates to hydroprocessing of hydrocarbon feedstocks for production of fuels and/or lubricant basestocks.

BACKGROUND OF THE INVENTION

Processing of gas oil feedstocks, such as a vacuum gas oil (VGO) feed, and other heavier feedstocks can pose a variety of challenges. One potential difficulty is presented by the boiling point range of the feed. Many of the high value uses of a gas oil feed can require conversion of at least a portion of the molecules in the feed to a lower boiling range. Some typical processes for conversion of feedstocks can include catalytic processes, such as some types of hydroprocessing. Unfortunately, hydroprocessing of such a feedstock can require substantial quantities of catalyst and hydrogen, leading to high costs for processing a feed.

U.S. Pat. No. 7,622,034 describes methods for hydroprocessing of a feed, such as a VGO feed, to produce a diesel product and an FCC feed. The initial feedstock is hydrotreated in a hydrotreatment zone. This produces an effluent that appears to have a sulfur content from about 200-1000 ppm. Some of the effluent from the hydrotreatment zone is then hydrocracked. After fractionation, at least a portion of the effluent that is exposed to hydrocracking is a diesel boiling range feed that appears to have a boiling range of about 140-382° C. and a sulfur content of about 100-2000 wppm. Optionally, a portion of the FCC feed can also be exposed to the hydrocracking. The effluent from the hydrocracking can be exposed to a post-treatment stage to remove any mercaptans formed in the naphtha portion of the hydrocracking product.

U.S. Pat. No. 7,449,102 describes methods for producing hydrocarbon products that include diesel products. The methods include hydrotreating a resid feedstock and separating the hydrotreated effluent into a gaseous and a liquid portion. The gaseous portion is combined with a gas oil feedstock and passed to a hydrocracking stage. In an example provided in the patent, the gas oil feedstock used in the hydrocracking stage has a sulfur content of more than about 2 wt %. The hydrocracked effluent is fractionated, the fractionation possibly resulting in a diesel range product.

U.S. Pat. No. 7,108,779 describes methods for producing hydrocarbon products that include diesel products. The methods include hydrotreating a feedstock and separating the hydrotreated effluent into a gaseous and a liquid portion. Part of the liquid portion is recycled to the hydrotreatment stage, while another part is described as being suitable as a feed for a fluid catalytic cracking process. The gaseous portion is combined with a hydrocarbon feed that boils below about 371° C. and is passed to a hydrocracking stage. The hydrocracked effluent is fractionated, resulting in a diesel range product.

U.S. Pat. No. 6,638,418 describes methods for processing at least two feeds. The first feed is hydrotreated in a first stage.

It does not appear that a sulfur content for the hydrotreated effluent from the first hydrotreatment stage is specified. The hydrotreated effluent is then passed into a hydrocracking stage, along with a recycled portion of the hydrocracking effluent. Another portion of the hydrocracked effluent is fractionated to produce at least a low sulfur diesel. A gaseous effluent from the hydrocracking stage is mixed with a second diesel range feed and hydrotreated in a second hydrotreatment stage. This also produces a portion of low sulfur diesel.

SUMMARY OF THE INVENTION

One aspect of the invention relates to a method for processing a hydrocarbon feedstock, which method includes mixing a hydrocarbon feed having a T5 boiling point of at least about 340° C. with a conversion stage effluent having a sulfur content of about 50 wppm or less to produce a mixed hydrocarbon feed. The mixed hydrocarbon feed can be hydrotreated in a hydrotreating stage by exposing the mixed hydrocarbon feed to a hydrotreating catalyst under effective hydrotreatment conditions to produce a hydrotreated effluent having a sulfur content of about 50 wppm or less. The hydrotreated effluent can be fractionated to produce at least a kerosene fraction having a sulfur content of about 10 wppm or less, a diesel fraction having a sulfur content of about 20 wppm or less, and a bottoms fraction. A bottoms feed fraction can be formed from the bottoms fraction, the bottoms feed fraction having a T5 boiling point of at least about 355° C. The bottoms feed fraction can be converted in a conversion stage by exposing the bottoms feed fraction to a dewaxing catalyst under effective conversion conditions to produce the conversion stage effluent. In the embodiment, the boiling point profile of the hydrotreated effluent can correspond to at least about 40% conversion of the hydrocarbon feed relative to a conversion threshold, the conversion threshold corresponding to the T5 boiling point of the bottoms feed fraction.

Another aspect of the invention relates to a method for processing a hydrocarbon feedstock, which method includes exposing a bottoms feed fraction having a T5 boiling point of at least about 355° C. to a dewaxing catalyst under effective conversion conditions in a conversion stage to form a conversion stage effluent. The conversion stage effluent and a hydrocarbon feed having a T5 boiling point of at least about 340° C. can be hydrotreated in a hydrotreating stage by exposing the conversion stage effluent and the hydrocarbon feed to a hydrotreating catalyst in the presence of a hydrogen treat gas under effective hydrotreatment conditions to produce a hydrotreated effluent having a sulfur content of about 50 wppm or less. The conversion stage effluent can include at least about 50% of the hydrogen treat gas in the hydrotreatment stage. The hydrotreated effluent can be fractionated to produce at least a kerosene fraction having a sulfur content of about 10 wppm or less, a diesel fraction having a sulfur content of about 20 wppm or less, and a bottoms fraction. At least about 25% of the bottoms fraction can be recycled to the conversion stage as part of the bottoms feed fraction. In the embodiment, the boiling point profile of the hydrotreated effluent can correspond to at least about 40% conversion of the hydrocarbon feed relative to a conversion threshold, the conversion threshold corresponding to the T5 boiling point of the bottoms feed fraction.

Still another aspect of the invention relates to a method for processing a hydrocarbon feedstock, comprising: hydrotreating a diesel boiling range hydrocarbon feedstock having a cloud point of at least −10° C. in a hydrotreating reactor by exposing the hydrocarbon feedstock to a hydrotreating catalyst having a hydrotreating catalyst cycle length in the presence of a hydrogen treat gas under effective hydrotreatment conditions comprising a hydrotreating weight average bed temperature to produce a hydrotreated effluent having a sulfur content of about 10 wppm or less; and cascading the hydrotreated effluent directly to a dewaxing reactor, separate from the hydrotreating reactor and thus with independent temperature control therefrom, to contact a dewaxing catalyst in the presence of hydrogen under effective dewaxing conditions comprising a dewaxing weight average bed temperature to form a hydrotreated and dewaxed effluent having (i) a cloud point of at most −26° C., (ii) a cloud point at least 17° C. lower than the cloud point of the diesel boiling range hydrocarbon feedstock, or (iii) both (i) and (ii), wherein a heater is optionally included downstream of the hydrotreating reactor to independently control a temperature difference between the hydrotreating and dewaxing reactors such that the dewaxing weight average bed temperature is at least 20° C. greater (e.g., from about 28° C. to about 61° C. greater) than the hydrotreating weight average bed temperature, and wherein the hydrotreating catalyst cycle length is at least 10% longer (e.g., at least 15% longer) than a comparative hydrotreating catalyst cycle length of an identical hydrotreating catalyst without independent temperature control in a single reactor along with dewaxing catalyst, which single reactor sees the identical hydrocarbon feedstock and outputs an otherwise similar, if not identical, hydrotreated and dewaxed effluent.

DETAILED DESCRIPTION OF THE EMBODIMENTS

Overview

Figure 1:
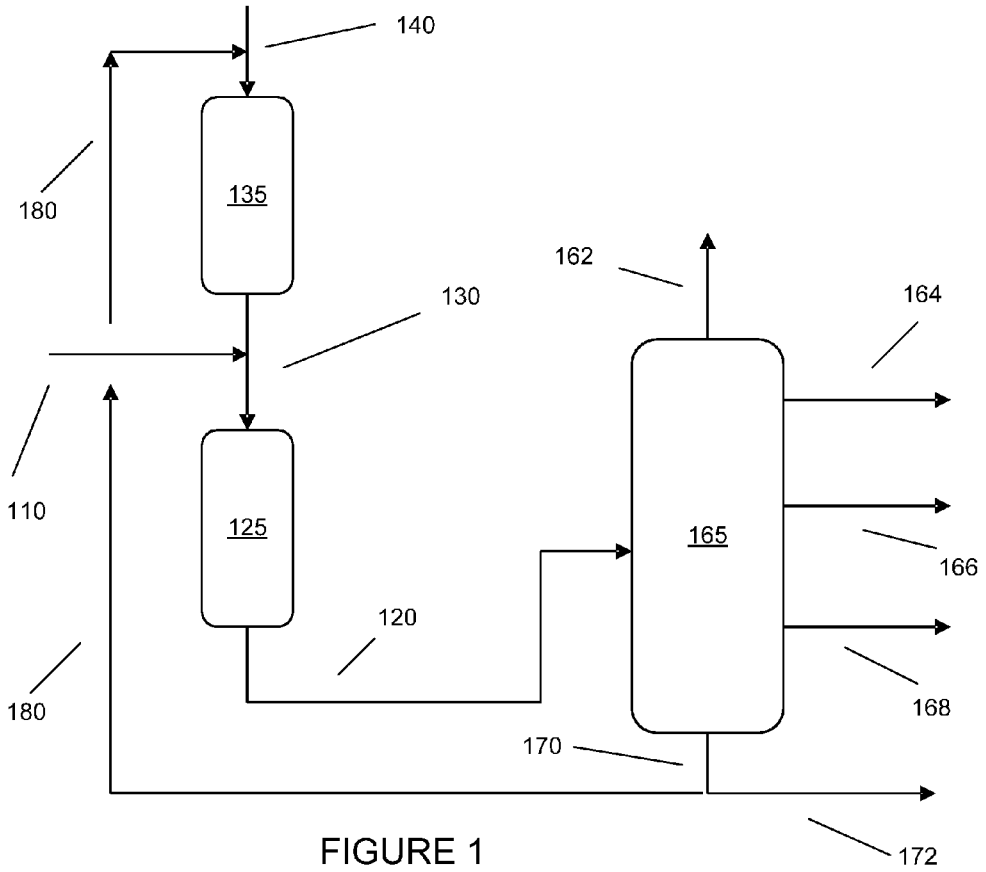
FIG. 1 depicts a reaction system suitable for performing a process according to the invention.

Some heavy feedstocks, such as vacuum gas oils, can serve as a source of both fuel products and lubricant basestocks. One desirable goal can be to increase the overall yield of (the combination of) fuels and lubricants, while minimizing the cost required. A typical vacuum gas oil feed can contain an amount of sulfur that is higher than the acceptable sulfur content for fuels. Thus, a desulfurization stage can be beneficial to reduce sulfur content to a desired level, such as less than about 10 wppm of sulfur. Another goal can be to increase the amount of fuels generated from a heavier feed, such as by conversion of the feed to lower boiling point compounds. A typical vacuum gas oil can also benefit from improvement of the cold flow properties, such as pour point. Thus, one possible process for treating a hydrocarbon feed can be to desulfurize the feed in a first reactor and then hydrocrack and/or dewax the feed in a second reactor. A fractionator can then be used to fractionate the resulting product into desired fuel and lubricant basestock cuts.

One potential method for reducing the cost of performing a desulfurization followed by cracking and/or dewaxing is to cascade the effluent of the desulfurization stage into the cracking/dewaxing stage without intermediate separation. This method could allow a single reactor to house both the desulfurization and cracking/dewaxing stages. Use of a single reactor, or another configuration where a separator is not required between reaction stages, can provide substantial cost savings in a refinery setting. Unfortunately, the sulfur compounds in a vacuum gas oil feed can reduce the activity of many dewaxing catalysts. This suppression of activity can occur when the sulfur is part of the feed (such as being covalently linked within a hydrocarbon molecule in the feed) and/or when the sulfur is in the form of a gas phase contaminant produced by desulfurization, such as $H_2S$. Thus, if the entire effluent of the desulfurization reaction is cascaded into a stage including a dewaxing catalyst, substantial poisoning of the catalyst can occur via either or both mechanisms. Catalyst poisoning can substantially increase the volume of catalyst required to effectively process a given flow rate of feed, and thus can lead to increased processing costs.

In various embodiments, systems and method are provided for processing a hydrocarbon feedstock, such as a vacuum gas oil feedstock. The systems and methods can allow a feedstock to be processed using two reaction stages (or groups of reaction stages) and a fractionator. In such embodiments, an additional separation device between the reaction stages is not required, which can optionally allow the stages to be housed in a single reactor. The absence of intermediate separation can reduce the cost of processing the feed by reducing the amount of equipment required for a process train. In an embodiment, the flow of the feedstock can be structured so that all of the feed initially flows into one or more desulfurization stages. The desulfurization can be performed under conditions effective to produce at least a diesel fraction having a sulfur content of about 10 wppm or less. The desulfurized feed can then be fractionated to generate several fractions, including at least a kerosene fraction, a diesel fraction, and a bottoms fraction. A portion of the bottoms fraction can be used as a lubricant feedstock and/or basestock. Another portion of the bottoms fraction can be passed into one or more conversion stages that, due to the relatively low sulfur content, can be sweet. Because of the initial desulfurization, the input flow into the one or more hydrocracking and/or conversion stages can have a sulfur content of about 50 wppm or less. The entire effluent from the conversion stages can be added to the input flow of the desulfurization stage. The catalyst used in the conversion stages can be a dewaxing and/or isomerization catalyst, in order to provide a further benefit to cold flow properties of any feed that passes through the hydrocracking stages.

In some embodiments, a reaction configuration according to the invention can provide at least some of the benefits of a multi-reactor system in a one reactor configuration. In such embodiments, the conversion stages and the desulfurization stages can be located in the same reactor. However, the stages can be arranged so that the desulfurization stages are downstream from the conversion stages. Thus, the effluent from the conversion stages can be cascaded into the desulfurization stages. The raw or unprocessed feed can also be introduced into the reactor so that the feed initially passes through the desulfurization stage. Thus, the input flows to the desulfurization stages can include both the unprocessed feed and the effluent from the conversion stages. In such embodiments, the input flow to the conversion stages can be a recycle feed of bottoms from the fractionator.

In some embodiments, the invention can also allow for production of a variety of fuel and/or lubricant cuts while both reducing the amount of equipment and the amount of catalyst in the conversion stages. As noted above, the inventive configuration can allow both the conversion and desulfurization stages to be housed in a single reactor, thus saving on the amount of equipment required. With regard to the catalyst volume, the inventive configuration can allow the conversion stages to be operated as "sweet" stages having low sulfur and/or nitrogen content. In part due to the low amount of contaminants/poisons, the conversion stages can be operated with a lower amount of catalyst as compared to a configuration where the effluent from a desulfurization stage is passed into the conversion stages. Additionally or alternately, the space velocity in the conversion stages can be increased relative to a configuration where the effluent from the desulfurization stage is passed into the conversion stages. In other embodiments, the invention can allow for production of an increased amount of diesel and/or kerosene for a fixed amount of conversion of lubricant basestock, as compared to a conventional method. Further, the resulting kerosene can have improved properties, such as an improved smoke point.

In the description below, references to boiling point profiles for heavier hydrocarbon fractions can correspond to boiling points determined in accordance with ASTM D1160. For boiling points in the diesel range and other lighter fractions where ASTM D1160 is not as appropriate, ASTM D86 can be used.

Feedstocks

In various embodiments, suitable hydrocarbon feedstocks can include feedstocks boiling in the distillate range. One example of a suitable feed is a diesel boiling range feed having a boiling range from about 450° F. (about 232° C.) to about 800° F. (about 427° C.). Another example of a suitable feed is a diesel boiling range feed that includes a kerosene cut. Such a feed can have a boiling range from about 250° F. (about 121° C.) to about 800° F. (about 427° C.). Still another example of a suitable feed can be a heavier feed having a boiling range from about 550° F. (about 288° C.) to about 1100° F. (about 593° C.). In other embodiments, distillate feeds with other initial or end boiling points within the above ranges can be used. In an embodiment, the initial boiling point of the distillate range feed can be at least about 250° F. (about 121° C.), at least about 350° F. (about 177° C.), at least about 450° F. (about 232° C.), at least about 500° F. (about 260° C.), or at least about 550° F. (about 288° C.). Additionally or alternately, the T5 boiling point (i.e., the temperature at which 5 wt % of the feed boils) can be at least about 250° F. (about 121° C.), at least about 350° F. (about 177° C.), at least about 450° F. (about 232° C.), at least about 500° F. (about 260° C.), or at least about 550° F. (about 288° C.). Additionally or independently, the end boiling point of the distillate range feed can be about 1100° F. (about 593° C.) or less, about 1000° F. (about 538° C.) or less, about 900° F. (about 482° C.) or less, about 800° F. (about 427° C.) or less, or about 700° F. (about 371° C.) or less. Further additionally or alternately, the T95 boiling point (i.e., the temperature at which 95 wt % of the feed boils) can be about 1100° F. (about 593° C.) or less, about 1000° F. (about 538° C.) or less, about 900° F. (about 482° C.) or less, about 800° F. (about 427° C.) or less, or about 700° F. (about 371° C.) or less.

Alternately, hydrocarbon feedstocks useful according to the methods of the invention can be identified according to their source—these may include mineral hydrocarbon feedstocks, biocomponent feedstocks, or a combination thereof.

A mineral hydrocarbon feedstock refers to a hydrocarbon feedstock derived from crude oil (including conventional crude oil, shale oil, etc.) that has optionally been subjected to one or more separation and/or other refining processes. A mineral hydrocarbon feedstock suitable for use in some embodiments of the invention can be a feedstock with an initial boiling point of at least about 550° F. (287° C.), or at least about 600° F. (316° C.), or at least about 650° F. (343° C.). Alternatively, the feedstock can be characterized by the boiling point required to boil a specified percentage of the feed. For example, the temperature required to boil at least 5 wt % of a feed is referred to as a "T5" boiling point. In an embodiment, the mineral hydrocarbon feedstock can have a T5 boiling point of at least about 644° F. (340° C.), or at least about 662° F. (350° C.). In another embodiment, the mineral hydrocarbon feed can have a T95 boiling point of about 1150° F. (621° C.) or less, or about 1100° F. (593° C.) or less, or about 1050° F. (566° C.) or less. Alternatively, the mineral hydrocarbon feed can have a final boiling point of about 1200° F. (649° C.) or less, or about 1150° F. (621° C.) or less, or about 1100° F. (593° C.) or less, or about 1050° F. (566° C.) or less. Examples of this type of feed can include gas oils, such as heavy gas oils or vacuum gas oils, virgin distillates, hydrotreated virgin distillates, and other crude fractions having an appropriate boiling range.

Mineral feedstreams can tend to have nitrogen contents from about 50 wppm to about 5000 wppm, for example from about 50 wppm to about 3500 wppm, from about 50 wppm to about 3000 wppm, from about 50 wppm to about 2500 wppm, from about 50 wppm to about 2000 wppm, from about 50 wppm to about 1500 wppm, from about 50 wppm to about 1000 wppm, from about 75 wppm to about 5000 wppm, from about 50 wppm to about 3500 wppm, from about 50 wppm to about 3000 wppm, from about 75 wppm to about 2500 wppm, from about 75 wppm to about 2000 wppm, from about 75 wppm to about 1500 wppm, from about 75 wppm to about 1000 wppm, from about 100 wppm to about 5000 wppm, from about 100 wppm to about 3500 wppm, from about 100 wppm to about 3000 wppm, from about 100 wppm to about 2500 wppm, from about 100 wppm to about 2000 wppm, from about 100 wppm to about 1500 wppm, or from about 100 wppm to about 1000 wppm. Additionally or alternately, mineral feedstreams can tend to have sulfur contents from about 100 wppm to about 20000 wppm, for example from about 100 wppm to about 15000 wppm, from about 100 wppm to about 10000 wppm, from about 100 wppm to about 7500 wppm, from about 100 wppm to about 5000 wppm, from about 100 wppm to about 4000 wppm, from about 100 wppm to about 3000 wppm, from about 100 wppm to about 2000 wppm, from about 200 wppm to about 20000 wppm, from about 200 wppm to about 15000 wppm, from about 200 wppm to about 10000 wppm, from about 200 wppm to about 7500 wppm, from about 200 wppm to about 5000 wppm, from about 200 wppm to about 4000 wppm, from about 200 wppm to about 3000 wppm, from about 200 wppm to about 2000 wppm, from about 350 wppm to about 20000 wppm, from about 350 wppm to about 15000 wppm, from about 350 wppm to about 10000 wppm, from about 350 wppm to about 7500 wppm, from about 350 wppm to about 5000 wppm, from about 350 wppm to about 4000 wppm, from about 350 wppm to about 3000 wppm, or from about 350 wppm to about 2000 wppm.

A biocomponent feedstock refers to a hydrocarbon feedstock derived from a biological raw material component, such as vegetable fats/oils, animal fats/oils, fish oils, pyrolysis oils, and algae fats/oils, as well as components of such materials. Note that for the purposes of this document, vegetable fats/oils refer generally to any plant based material, and include fat/oils derived from a source such as plants from the genus *Jatropha*. The vegetable, animal, fish, and algae fats/oils that can be used in the present invention can advantageously include any of those which comprise triglycerides and/or free fatty acids (FFA). The triglycerides and FFAs typically contain aliphatic hydrocarbon chains in their structure having from 8 to 36 carbons, preferably from 10 to 26 carbons, for example from 14 to 22 carbons. Other types of feed that are derived from biological raw material components include fatty acid esters, such as fatty acid alkyl esters (e.g., FAME and/or FAEE). Examples of biocomponent feedstocks include but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, rice bran oil, and the like, and combinations thereof.

In one embodiment, the biocomponent feedstock can include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof. Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes. In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used include, but are not limited to, rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, and rice bran oil. Vegetable oils as referred to herein can also include processed vegetable oil material. Non-limiting examples of processed vegetable oil material include fatty acids and fatty acid alkyl esters. Alkyl esters typically include $C_1$-$C_5$ alkyl esters. One or more of methyl, ethyl, and propyl esters are preferred.

Examples of animal fats that can be used include, but are not limited to, beef fat (tallow), hog fat (lard), turkey fat, fish fat/oil, and chicken fat. The animal fats can be obtained from any suitable source including restaurants and meat production facilities. Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids can be contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the algal biomass itself. Algal sources for algae oils can include, but are not limited to, unicellular and multicellular algae. Examples of such algae can include a rhodophyte, chlorophyte, heterokontophyte, tribophyte, glaucophyte, chlorarachniophyte, euglenoid, haptophyte, cryptomonad, dinoflagellum, phytoplankton, and the like, and a combination thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochrysis carterae, Prymnesium parvum, Tetraselmis chui*, and *Chlamydomonas reinhardtii.*

Biocomponent feedstreams can typically have low nitrogen and sulfur content. For example, a biocomponent feedstream can contain up to about 500 parts per million by weight (wppm) nitrogen (in the form of nitrogen-containing compounds). Instead of nitrogen and/or sulfur, the primary heteroatom component in biocomponent feeds is typically oxygen (in the form of oxygen-containing compounds). Suitable biocomponent feedstreams can include up to about 10-12 wt % oxygen. In preferred embodiments, the sulfur content of the biocomponent feedstream can advantageously be about 15 wppm or less, preferably about 10 wppm or less, although, in some embodiments, the biocomponent feedstream can be substantially free of sulfur (e.g., can contain no more than 10 wppm, preferably no more than 5 wppm, no more than 3 wppm, no more than 2 wppm, no more than 1 wppm, no more than 500 wppb, no more than 200 wppb, no more than 100 wppb, no more than 50 wppb, or completely no measurable sulfur).

In various embodiments, a feed can include both feeds from biocomponent sources and feeds from mineral sources. Such mixed feeds can include at least about 0.1 wt % of the biocomponent feed, for example at least about 0.5 wt %, at least about 1 wt %, at least about 3 wt %, at least about 5 wt %, at least about 10 wt %, at least about 15 wt %, at least about 20 wt %, or at least about 25 wt %. Additionally or alternately, the mixed feed can include about 75 wt % or less of the biocomponent feed, for example about 65 wt % or less, about 55 wt % or less, about 50 wt % or less, about 45 wt % or less, about 40 wt % or less, about 35 wt % or less, or about 30 wt % or less. Such mixed feeds can include at least about 10 wt % of a mineral feed, for example at least about 20 wt %, at least about 25 wt %, at least about 30 wt %, at least about 35 wt %, at least about 40 wt %, at least about 45 wt %, at least about 50 wt %, at least about 55 wt %, at least about 60 wt %, at least about 65 wt %, at least about 70 wt %, at least about 75 wt %, at least about 80 wt %, at least about 85 wt %, at least about 90 wt %, at least about 95 wt %, at least about 97 wt %, at least about 98 wt %, at least about 99 wt %, at least about 99.5 wt %, or at least about 99.9 wt %. Additionally or alternately, the mixed feed can include about 99.9 wt % or less of the mineral feed, for example about 99.5 wt % or less, about 99 wt % or less, about 98 wt % or less, about 97 wt % or less, about 95 wt % or less, about 90 wt % or less, about 85 wt % or less, about 80 wt % or less, about 75 wt % or less, about 70 wt % or less, about 65 wt % or less, about 60 wt % or less, about 55 wt % or less, about 50 wt % or less, about 45 wt % or less, about 40 wt % or less, about 35 wt % or less, about 30 wt % or less, or about 25 wt % or less.

The feedstock can also be characterized in terms of other properties, such as cold flow properties. For example, the feedstock can have a pour point of at least about 20° C., for example at least about 25° C., or least about 30° C., or at least about 35° C. Additionally or alternately, the feedstock can have an aromatics content of at least about 20 wt %, for example at least about 30 wt %, at least about 40 wt %. With regard to the aromatics content, the feedstock can additionally or alternately exhibit about 60 wt % or less aromatics, for example about 55 wt % or less or about 50 wt % or less.

Desulfurization

One option for desulfurizing a feedstock is to hydrotreat the feedstock. Desulfurization can include exposing the feedstock to one or more beds of catalyst in one or more hydrotreatment stages. Optionally, one or more partial beds, full beds, and/or stages of hydrocracking catalyst can also be used. A hydrotreatment process can typically involve exposing a feed to a catalyst in the presence of a hydrogen-containing treat gas. In some embodiments, the hydrotreating catalyst can include, but is not necessarily limited to, a Group VIB metal and/or a Group VIII metal, optionally deposited on a support. Suitable metals can include cobalt, nickel, molybdenum, tungsten, and combinations thereof. In some embodiments, the hydrotreating catalyst can only a single Group VIB metal and/or only a single Group VIII metal. Suitable supports, when present, can include, but are not limited to, silica, silica-alumina, alumina, titania, zirconia, and combinations thereof. In some embodiments, multiple beds of catalyst can be used, with each bed of catalyst being the same or different as each other bed of catalyst. Multiple hydrotreatment stages can also be used within a reactor.

The reaction conditions in a hydrotreatment stage can be conditions suitable for reducing the sulfur content of the feedstream. For instance, the reaction conditions can include one or more of: an LHSV from about 0.05 $hr^{-1}$ to about 20 $hr^{-1}$, for example from about 0.1 $hr^{-1}$ to about 10 $hr^{-1}$, from about 0.3 $hr^{-1}$ to about 5.0 $hr^{-1}$, or from about 0.5 $hr^{-1}$ to about 1.5 $hr^{-1}$; a total hydrogen pressure from about 250 psig (about 1.7 MPag) to about 5000 psig (about 34 MPag), for example from about 500 psig (about 3.4 MPag) to about 3000 psig (about 21 MPag) or from about 1400 psig (about 9.7 MPag) to about 2000 psig (about 14 MPag); a hydrogen treat gas ratio from about 100 scf/bbl (17 $Nm^3/m^3$) to about 5000 scf/bbl (840 $Nm^3/m^3$); and a temperature from about 500° F. (about 260° C.) to about 800° F. (about 427° C.), for example from about 650° F. (about 343° C.) to about 700° F. (about 371° C.) or from about 700° F. (about 371° C.) to about 750° F. (about 399° C.).

During hydrotreatment, the sulfur and nitrogen contents of a feedstock are typically reduced. The reaction conditions in a hydrotreatment reactor can be conditions effective for reducing the sulfur and/or nitrogen content of the feedstream. In an embodiment, the sulfur content of the feed can be reduced to about 30 wppm or less, for example about 20 wppm or less, about 15 wppm or less, about 10 wppm or less, or about 5 wppm or less. Additionally or alternately, the nitrogen content of the feed can be reduced to about 20 wppm or less, for example about 15 wppm or less, about 10 wppm or less, about 5 wppm or less, or about 3 wppm or less.

For biocomponent feeds, the sulfur, nitrogen, and aromatic contents are often relatively low. Nevertheless, hydrotreatment can also reduce the oxygen content of biocomponent feeds. Deoxygenating a feed can avoid problems with catalyst poisoning or deactivation due to the creation of water or carbon oxides during hydroprocessing. Substantially deoxygenating the feedstock can correspond to reducing the oxygenate level of the total feedstock to 0.1 wt % or less, for example 0.05 wt % or less, 0.01 wt % or less, 0.005 wt % or less, or to a level measurably indistinct from 0. After a hydrotreatment process, a hydrotreated biocomponent feed will also have increased similarity to a hydrotreated mineral oil feed. However, the hydrotreated biocomponent feed can typically have less favorable cold flow properties relative to a comparable hydrotreated mineral feed. While the hydrotreated biocomponent feed can have the viscosity characteristics of, e.g., a diesel fuel, the cold flow properties can often restrict the use of a hydrotreated biocomponent feed to, for example, a diesel fuel suitable only for warm weather applications.

In some embodiments, desulfurization of the feed can also include use of some hydrocracking catalyst. The hydrocracking catalyst can be included as part of a bed and/or stage that contains hydrotreatment catalyst, or hydrocracking catalyst can be included in a separate bed and/or stage within the multiple desulfurization stages. Examples of hydrocracking catalysts can include, but are not limited to, supported catalysts containing nickel, nickel-cobalt-molybdenum, cobalt-molybdenum, nickel-tungsten, or nickel-molybdenum components deposited thereon. In another embodiment, the hydrocracking catalyst can include nickel and at least one of tungsten and molybdenum. Other examples of hydrocracking catalysts can include noble metal catalysts, non-limiting examples of which are those based on platinum and/or palladium. Porous support materials, which may be used for both the noble and non-noble metal hydrocracking catalysts can comprise a refractory oxide material including, but not limited to, alumina, silica, alumina-silica, kieselguhr, diatomaceous earth, magnesia, zirconia, or a combination thereof, with alumina, silica, and alumina-silica being preferred (and most common). Zeolitic supports including the large pore faujasites such as USY can additionally or alternately be used. In an embodiment, the hydrocracking conditions can be selected based on the hydrotreating conditions. In another embodiment, the hydrotreating conditions can be selected based on effective hydrocracking conditions. Suitable hydrocracking conditions can include one or more of a temperature from about 200° C. to about 450° C., a total pressure from about 5 barg (about 0.5 MPag) to about 300 barg (about 30 MPag), (when hydrogen is present) a hydrogen-containing treat gas ratio from about 100 scf/bbl (about 17 $Nm^3/m^3$) to about 5000 scf/bbl (about 840 $Nm^3/m^3$), and an LHSV from about 0.05 $hr^{-1}$ to about 10 $hr^{-1}$.

A treat gas ratio for hydrogen can also be specified for the desulfurization stages. In an embodiment, hydrogen treat gas can be introduced into the desulfurization stages by cascading the entire effluent from the hydrocracking stages into the desulfurization stages. Optionally, some make-up hydrogen-containing gas can also be introduced into the desulfurization stages. The make-up gas can correspond to 20% or less of the hydrogen flow rate into the desulfurization stages, for example 10% or less or 5% or less. Additionally or alternately, at least about 50% of the hydrogen flow rate into the desulfurization stages can be hydrogen that is cascaded into the desulfurization stages from the conversion stages, for example at least about 70% or at least about 80%. In an embodiment, the treat gas rate for the desulfurization stages can be from about two to about five times the amount of hydrogen to be consumed per barrel of fresh feed in the stage. A typical hydrotreatment stage can consume from about 50 scf/bbl (about 8.4 $Nm^3/m^3$) to about 1000 scf/bbl (about 170 $Nm^3/m^3$) of hydrogen, depending on various factors including but not limited to the nature of the feed being hydrotreated. Based on those numbers, the treat gas rate can be from about 100 scf/bbl (about 17 $Nm^3/m^3$) to about 5000 scf/bbl (about 840 $Nm^3/m^3$). Alternately, the treat gas rate can be from about four to about five time the amount of hydrogen to be consumed. Note that the above treat gas rates refer to the rate of hydrogen flow. If hydrogen is delivered as part of a gas stream having less than 100% hydrogen, the treat gas rate for the overall gas stream can be proportionally higher.

The conditions in the desulfurization stages can advantageously be effective to convert at least a portion of the feedstock into lower boiling compounds. In an embodiment, the desulfurization stages can convert at least about 5% of compounds in the feed boiling above about 355° C. into compounds boiling below about 355° C., for example at least about 10% or at least about 15% of compounds in the feed. Additionally or alternately, the desulfurization stages can convert about 30% or less of compounds in the feed boiling above about 355° C. into compounds boiling below about 355° C., for example about 25% or less or about 20% or less.

Conversion Stage

In addition to desulfurization stages, various embodiments can also include one or more conversion stages. These stages can be referred to as "sweet" stages because the input feed into these stages can advantageously have a relatively low sulfur content, such as about 50 wppm or less, for example about 30 wppm or less, about 20 wppm or less, about 15 wppm or less, or about 10 wppm or less. The input feed to the conversion stages can be a portion of the fractionated bottoms of the effluent from the desulfurization stages. In an embodiment, the input feed can have an initial boiling point of about 355° C. or greater, for example about 370° C. or greater or about 380° C. or greater. Additionally or alternately, the input feed can have a T5 boiling point of about 355° C. or greater, for example about 370° C. or greater or about 380° C. or greater.

The catalyst for the conversion stages can be a catalyst that is also suitable for use as a dewaxing and/or isomerization catalyst. In other words, a dewaxing catalyst can be used in a stage that is operated under effective hydrocracking and/or conversion conditions. Using a dewaxing and/or isomerization catalyst in a conversion/hydrocracking stage can provide the added benefit of isomerizing the feed during hydrocracking. This can produce additional benefits for the cold flow properties of the effluent from the conversion stage. Suitable dewaxing/isomerization catalysts can include, but are not limited to, molecular sieves such as crystalline aluminosilicates (zeolites) or silico-aluminophosphates (SAPOs). In an embodiment, the molecular sieve can comprise or be ZSM-5, ZSM-23, ZSM-35, ZSM-48, zeolite Beta, or a combination thereof, for example ZSM-23 and/or ZSM-48. Additionally or alternately, the molecular sieve can comprise or be a 10-member ring 1-D molecular sieve. Optionally, the dewaxing/isomerization catalyst can include a binder for the molecular sieve such as those mentioned hereinabove, for instance alumina, titania, silica, silica-alumina, zirconia, or a combination thereof. In an embodiment, the binder can be alumina, titania, or a combination thereof in another embodiment, the binder can be titania, silica, zirconia, or a combination thereof.

One characteristic of molecular sieves that can impact the activity of the molecular sieve is its ratio of silica to alumina ($Si/Al_2$). In one embodiment, the molecular sieve can have a silica to alumina ratio of about 200:1 or less, for example about 120:1 or less, about 100:1 or less, about 90:1 or less, or about 75:1 or less. Additionally or alternately, the molecular sieve can have a silica to alumina ratio of at least about 30:1, for example at least about 45:1, at least about 50:1, at least about 55:1, at least about 60:1, at least about 65:1, at least about 70:1, or at least about 75:1.

The dewaxing/isomerization catalyst can also generally include a metal hydrogenation component, such as a Group VIII metal. Suitable Group VIII metals can include Pt, Pd, Ni, Co, or combinations thereof. When present, the Group VIII metal can comprise at least about 0.1 wt % of the catalyst weight, for example at least about 0.3 wt %, at least about 0.5 wt %, at least about 1.0 wt %, at least about 2.0 wt %, at least about 2.5 wt %, at least about 3.0 wt %, at least about 4.0 wt %, or at least about 5.0 wt %. Additionally or alternately, the Group VIII metal can comprise about 15 wt % or less of the catalyst weight, for example about 10 wt % or less, about 5.0 wt % or less, about 4.0 wt % or less, about 3.0 wt % or less, about 2.5 wt % or less, about 2.0 wt % or less, or about 1.5 wt % or less.

In some embodiments, in addition to a Group VIII hydrogenation metal, the dewaxing/isomerization catalyst can also include a Group VIB metal, such as W and/or Mo. When present, typically in combination with a Group VIII metal, the catalyst can include at least about 0.5 wt % of the Group VIB metal, for example at least about 1.0 wt %, at least about 2.0 wt %, at least about 2.5 wt %, at least about 3.0 wt %, at least about 4.0 wt %, or at least about 5.0 wt %. Additionally or alternately, the Group VIII metal can comprise about 20 wt % or less of the catalyst weight, for example about 15 wt % or less, about 10 wt % or less, about 5.0 wt % or less, about 4.0 wt % or less, about 3.0 wt % or less, about 2.5 wt % or less, about 2.0 wt % or less, about 1.5 wt % or less, or about 1.0 wt % or less. In one embodiment, the catalyst can include Pt, Pd, or a combination thereof. In another embodiment, the catalyst can include Ni and W, Ni and Mo, or Ni and a combination of W and Mo.

In some embodiments, a portion of the catalyst in the conversion stages can be a hydrocracking catalyst, such as the hydrocracking catalysts described above in the desulfurization stages. When dewaxing/isomerization catalyst is present, its volume can be at least about 30% of the total catalyst volume in the conversion stages, for example at least about 50% or at least about 75%. Optionally, the conversion stage can include up to about 100% of a hydrocracking catalyst, such as USY.

The reaction conditions in the conversion stages can be reaction conditions suitable for converting at least a portion of the feed that has a boiling point above about 355° C. to components having a boiling point of about 355° C. or less. Additionally or alternately, the boiling point for measuring the conversion can be based on the initial boiling point (or the T5 boiling point) of the portion of the bottoms fraction that is recycled to the conversion stages. In an embodiment, the reaction conditions can be selected so that the overall conversion of the feedstock from both the desulfurization and the hydrocracking stages is at least about 40%, for example at least about 50%, at least about 60%, or at least about 70%. Additionally or alternately, the overall conversion of the feedstock from both the desulfurization and conversion stages can be about 90% or less, for example about 80% or less, about 70% or less, about 60% or less, or about 50% or less. Suitable conversion conditions can include one or more of a temperature from about 200° C. to about 450° C., a total pressure from about 5 barg (about 0.5 MPag) to about 300 barg (about 30 MPag), (when hydrogen is present) a hydrogen-containing treat gas ratio from about 100 scf/bbl (about 17 $Nm^3/m^3$) to about 5000 scf/bbl (about 840 $Nm^3/m^3$), and an LHSV from about 0.05 $hr^{-1}$ to about 10 $hr^{-1}$. Additionally or alternately, the LHSV can be at least about 0.5 $hr^{-1}$ or at least about 1.0 $hr^{-1}$. Further additionally or alternately, the space velocity of the conversion stages can be at least about twice as great as the space velocity of a configuration where the effluent from the desulfurization stage is passed into the conversion stage.

In an embodiment, the treat gas rate can be based in part on the amount of hydrogen consumed in the conversion stages, plus the amount of hydrogen consumed in the desulfurization stage. In such an embodiment, because hydrogen for the desulfurization stage by cascading the hydrogen through the conversion stage, the conversion stage can have an excess of hydrogen. The amount of hydrogen can be selected to be from about two to about five times the amount to be consumed by the combination of the conversion and desulfurization stages. In one embodiment, the combination of conversion and desulfurization stages can consume from about 50 scf/bbl (about 8.4 $Nm^3/m^3$) to about 1000 scf/bbl (about 170 $Nm^3/m^3$) of hydrogen, depending on various factors including but not limited to the nature of the feed. Based on those numbers, the treat gas rate can be from about 100 scf/bbl (about 17 $Nm^3/m^3$) to about 5000 scf/bbl (about 840 $Nm^3/m^3$). Alternately, the treat gas rate can be from about four to about five time the amount of hydrogen to be consumed. Note that the above treat gas rates refer to the rate of hydrogen flow. If hydrogen is delivered as part of a gas stream having less than 100% hydrogen, the treat gas rate for the overall gas stream can be proportionally higher.

Fractionation of Products

In some embodiments, a feedstock can travel the following flow path in a system according to the invention. According to one flow path, the feedstock can be introduced into the desulfurization stages. After desulfurization, the feed can flow to a fractionator. Various product cuts can be separated out, possibly including a light ends fraction, a naphtha fraction, a kerosene fraction, a diesel fraction, and a bottoms fraction. At least a portion of the bottoms fraction can be used as a lubricant basestock or feedstock. Any remaining portion of the bottoms fraction can be passed into the conversion stages. The effluent from the conversion stages can then be cascaded into the desulfurization stages (e.g., directly and without any separation), and then subsequently back to the fractionator.

The bottoms fraction can correspond to a fraction that has an initial boiling point of at least about 355° C., for example at least about 370° C. or at least about 380° C., and/or that has a T5 boiling point of at least about 355° C., for example at least about 370° C. or at least about 380° C. The bottoms fraction can correspond to a fraction of the feed that has not been converted in one or both of the desulfurization and conversion stages. The bottoms fraction can exhibit one or more of the following properties/characteristics: a sulfur content of about 50 wppm or less; an aromatics content of about 5 wt % or less (e.g., about 2.5 wt % or less, about 2.0 wt % or less, or about 1.5 wt % or less); a pour point of about −5° C. or less (e.g., about −10° C. or less); and a viscosity index of at least about 90 (e.g., at least about 95). In one embodiment, a portion of the bottoms fraction can be used as the input feed for the conversion stages, while the remaining portion can be used as lubricant basestock or feedstock.

The amount of the bottoms fraction used as input feed for the conversion stages can depend on the desired balance between generating lubricant basestocks and generating fuels. In an embodiment, at least about 20% of the bottoms fraction can be used as an input feed for the conversion stages, for example at least about 40%, at least about 50%, at least about 60%, or at least about 70%. Additionally or alternately, about 90% or less of the bottoms fraction can be used as an input feed for the conversion stages, for example about 75% or less, about 60% or less, about 50% or less, or about 40% or less.

A diesel fraction can have an initial boiling point of at least about 260° C., for example at least about 270° C. or at least about 280° C., and/or a T5 boiling point of at least about 260° C., for example at least about 270° C. or at least about 280° C. Additionally or alternately, the end boiling point for the diesel fraction can be about 355° C. or less, for example about 370° C. or less or about 380° C. or less, and/or the T95 boiling point for the diesel fraction can be about 355° C. or less, for example about 370° C. or less or about 380° C. or less. Additionally or alternately, the end boiling point and/or the T95 boiling point for the diesel fraction can approximately correspond to the initial boiling point and/or the T5 boiling point, respectively, for the bottoms fraction. Note that depending on the nature of the fractionation, there can be some overlap between the boiling range for the diesel fraction and the boiling range for the bottoms fraction.

The diesel fraction can have a sulfur content of about 30 wppm or less, for example about 20 wppm or less, about 15 wppm or less, or about 10 wppm or less. Additionally or alternately, the diesel fraction can have a cetane index of at least about 40, for example at least about 45. Additionally or alternately, the diesel fraction can have a cloud point of about −20° C. or less, for example about −25° C. or less.

A kerosene fraction can have an initial boiling point of at least about 150° C., for example at least about 155° C. or at least about 160° C., and/or a T5 boiling point of at least about 150° C., for example at least about 155° C. or at least about 160° C. Additionally or alternately, the end boiling point for the kerosene fraction can be about 280° C. or less, for example about 270° C. or less or about 260° C. or less, and/or the T95 boiling point for the kerosene fraction can be about 280° C. or less, for example about 270° C. or less or about 260° C. or less. Additionally or alternately, the end boiling point and/or the T95 boiling point for the kerosene fraction can approximately correspond to the initial boiling point and/or the T5 boiling point, respectively, for the diesel fraction. Note that depending on the nature of the fractionation, there can be some overlap between the boiling range for the kerosene fraction and the boiling range for the diesel fraction.

The kerosene fraction can have a sulfur content of about 20 wppm or less, for example about 15 wppm or less, about 10 wppm or less, or about 5 wppm or less. Additionally or alternately, the smoke point for the kerosene fraction, as measured by flame height, can be at least about 25 mm, for example at least about 30 mm, at least about 34 mm, or at least about 35 mm.

A naphtha fraction can also have a sulfur content of about 15 wppm or less, for example about 10 wppm or less or about 5 wppm or less. The boiling range for the naphtha portion can be from about the boiling point of a C5 hydrocarbon (e.g., at least about 35° C.) to about 160° C. (e.g., to about 155° C. or less or to about 150° C. or less). Additionally or alternately, the end boiling point and/or the T95 boiling point for the naphtha fraction can approximately correspond to the initial boiling point and/or the T5 boiling point, respectively, for the kerosene fraction.

A light ends fraction can include a variety of compounds, including contaminant gases formed during hydrotreatment such as $H_2S$ and $NH_3$. The light ends fraction can also include $C_1$-$C_4$ hydrocarbons, as well as any other compounds that have a lower boiling point than the naphtha fraction.

Sample Reaction System

FIG. 1 shows an example of a reaction system according to the invention. A feedstock 110 is introduced into desulfurization stage 125. The effluent 130 from hydrocracking stage 135 can also be introduced into desulfurization stage 125. The effluent 130 from conversion stage 135 can include excess hydrogen introduced 140 into the conversion stage. Optionally, make up hydrogen (not shown) can also be added to desulfurization stage 125. The output stream 120 from desulfurization stage 125 can be introduced into fractionator 165, which can produce a variety of cuts, including a light ends fraction 162, optionally a naphtha fraction 164, optionally a kerosene fraction 166, a diesel fraction 168, and a bottoms fraction 170. A portion 172 of bottoms fraction 170 can be used as a lubricant basestock and/or sent for further processing as a lubricant feedstock. Another portion 180 of bottoms fraction 170 can be used as the input feed for conversion stage 135.

Independent Temperature Control—Hydrotreating Separate from Dewaxing

In another aspect of the invention, a hydrocarbon feed, e.g., having predominantly diesel boiling range perhaps with some higher boiling components, can be processed using a combination of hydrotreating and dewaxing to obtain a hydrotreated and dewaxed effluent/product. In such processing, the hydrotreating step can be first, in a separate hydrotreating reactor, and the dewaxing step can be second, in a separate dewaxing reactor, even though the hydrotreated effluent from the hydrotreating reactor can be cascaded directly (without treatment) to the dewaxing reactor. In this way, more control can be independently exercised over the conditions in each separate reactor, e.g., specifically regarding hydrotreating temperature and dewaxing temperature.

Thus, according to this aspect of the invention, a method for processing a hydrocarbon feedstock can include a first step of hydrotreating a diesel boiling range hydrocarbon feedstock in a hydrotreating reactor by exposing the hydrocarbon feedstock to a hydrotreating catalyst in the presence of a hydrogen treat gas under effective hydrotreatment conditions comprising a hydrotreating weight average bed temperature to produce a hydrotreated effluent having a sulfur content of about 30 wppm or less, e.g., about 20 wppm or less, about 15 wppm or less, about 10 wppm or less, about 8 wppm or less, about 7 wppm or less, about 5 wppm or less, or about 3 wppm or less. The hydrotreating catalyst, hydrogen treat gas, and effective hydrotreatment conditions can include those disclosed hereinabove. In some embodiments, the hydrotreating weight average bed temperature can be from about 550° F. (about 288° C.) to about 750° F. (about 399° C.), for example from about 600° F. (about 316° C.) to about 725° F. (about 385° C.), from about 650° F. (about 316° C.) to about 725° F. (about 385° C.), or from about 650° F. (about 343° C.) to about 700° F. (about 371° C.).

The diesel boiling range hydrocarbon feedstock can be characterized in one or more of several ways, such as by boiling point, cloud point, and the like. In some embodiments, the boiling point of the hydrocarbon feedstock can be described by: an initial boiling point of at least about 260° C., for example at least about 270° C. or at least about 280° C.; a T5 boiling point of at least about 260° C., for example at least about 270° C. or at least about 280° C.; a T95 boiling point of about 380° C. or less, for example about 370° C. or less or about 355° C. or less; or a final boiling point of about 380° C. or less, for example about 370° C. or less or about 355° C. or less. Additionally or alternately, the cloud point of the hydrocarbon feedstock can be at least −10° C., for example at least −9° C., at least −5° C., at least 0° C., at least 5° C., at least 10° C., or at least 15° C., and/or can be at most 25° C., at most 20° C., at most 15° C., at most 12° C., at most 10° C., at most 6° C., at most 5° C., or at most 0° C.

Further according to this aspect of the invention, the method for processing a hydrocarbon feedstock can include a second step of cascading the hydrotreated effluent directly to a dewaxing reactor, separate from the hydrotreating reactor and thus with independent temperature control therefrom, to contact a dewaxing catalyst in the presence of hydrogen under effective dewaxing conditions comprising a dewaxing weight average bed temperature to form a hydrotreated and dewaxed effluent. The dewaxing catalyst and dewaxing conditions can include those disclosed hereinabove, with the dewaxing weight average bed temperature comprised in ranges similar to the dewaxing temperature disclosed hereinabove. Furthermore, the hydrogen can be from a hydrogen in the dewaxing can generally include left over (unreacted) hydrogen cascaded with the effluent from the hydrotreatment stage, but may optionally come from additional and/or recycled treat gas containing hydrogen (abbreviated here as hydrogen treat gas). In some preferred embodiments, the hydrotreated and dewaxed effluent (typically after removal of unwanted gaseous components such as hydrogen, $H_2S$, and the like) can exhibit (i) a cloud point of at most −26° C. (e.g., −28° C. or less, −30° C. or less, −32° C. or less, or −34° C. or less), (ii) a cloud point at least 17° C. lower (e.g., at least 18° C. lower, at least 19° C. lower, at least 20° C. lower, at least 21° C. lower, at least 22° C. lower, at least 23° C. lower, at least 24° C. lower, or at least 25° C. lower) than the cloud point of the diesel boiling range hydrocarbon feedstock, or (iii) both (i) and (ii).

Advantageously in this aspect of the invention, the method can be conducted so that the dewaxing weight average bed temperature is at least 20° C. greater (e.g., from about 28° C. to about 61° C. greater) than the hydrotreating weight average bed temperature.

In this aspect of the invention, the hydrotreating catalyst can have a hydrotreating catalyst cycle length, which can represent the length of time that product meeting desired characteristics can be economically obtained from the reactor system; usually such cycle lengths are limited (in such configurations) by the increase in temperature necessary to meet. In advantageous embodiments according to the invention, the hydrotreating catalyst cycle length can be considerably longer (at least 10% longer, e.g., at least 15% longer, at least 20% longer, at least 25% longer, at least 30% longer, at least 35% longer, at least 40% longer, at least 45% longer, at least 50% longer, at least 55% longer, at least 60% longer, at least 65% longer, at least 70% longer, or at least 75% longer; additionally or alternately up to 125% longer, for example up to 100% longer, up to 95% longer, up to 90% longer, up to 85% longer, up to 80% longer, or up to 75% longer) than a comparative hydrotreating catalyst cycle length of an identical hydrotreating catalyst without independent temperature control in a single reactor along with dewaxing catalyst (or in a system with separate reactors cascaded but with temperature control in the form of a heater only upstream of the hydrotreating reactor), which system sees the identical hydrocarbon feedstock and outputs an otherwise similar, if not identical, hydrotreated and dewaxed effluent.

Figure 3:
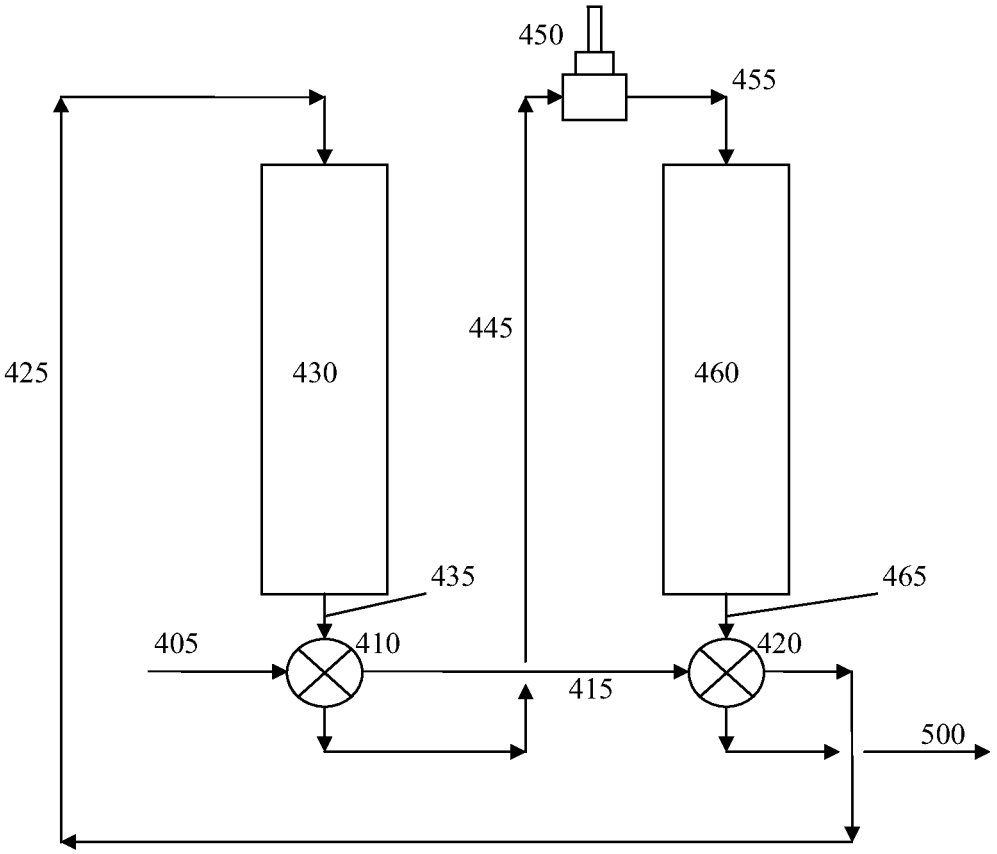
FIG. 3 depicts an embodiment of a cascaded two-reactor hydrotreating and dewaxing system suitable for performing a process according to the invention.
Figure 4:
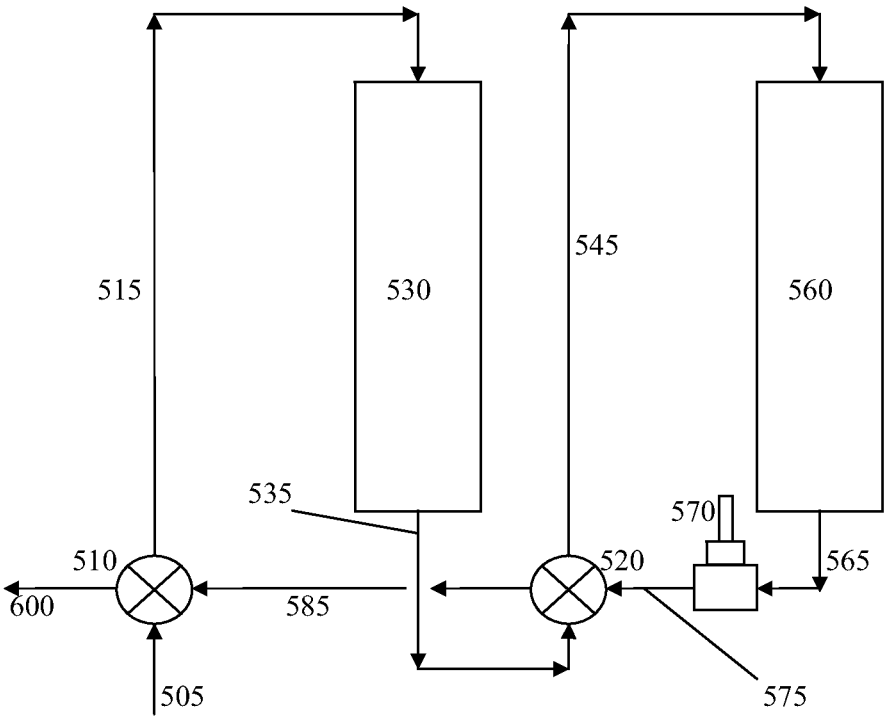
FIG. 4 depicts another embodiment of a cascaded two-reactor hydrotreating and dewaxing system suitable for performing a process according to the invention.

FIGS. 3 and 4 show embodiments according to this aspect of the invention that show temperature control of the hydrotreating reactor decoupled from the dewaxing reactor.

In FIG. 3, hydrocarbon feed 405 can optionally go through heat exchanger 410 (becoming heated feedstream 415) and/or optionally go through heat exchanger 420 (becoming heated feedstream 425) before entering hydrotreating reactor 430, where it can be combined with a hydrogen-containing treat gas stream (not shown) to contact a hydrotreating catalyst under effective hydrotreating conditions. The hydrotreated effluent from the hydrotreating reactor can be cascaded directly (without treatment) through line 435 and ultimately into the dewaxing reactor 460. Optionally, some heat from the hydrotreated effluent in line 435 can be transferred to feed 405 in heat exchanger 410, at which point the slightly cooled hydrotreated effluent (or merely just the hydrotreated effluent, if optional heat exchanger 410 is not present) in line 445 can be brought up to dewaxing temperature in heater 450. Heater 450 can be a means of independent temperature control for the dewaxing reactor 460, separate from the hydrotreating reactor 430. (Re-)Heated effluent can then flow through line 455 into dewaxing reactor 460, where the left over (cascaded) unreacted hydrogen and the hydrotreated effluent can collectively contact a dewaxing catalyst under effective dewaxing conditions. Optionally, the unreacted hydrogen can be supplemented and/or augmented in the dewaxing reactor by additional hydrogen-containing treat gas stream (not shown), if desired. According to FIG. 3, the hydrotreated and dewaxed effluent can then exit the dewaxing reactor 460 through line 465. Optionally, some heat from the hydrotreated and dewaxed effluent in line 465 can be transferred to feed 415 in heat exchanger 420, thus forming slightly cooled hydrotreated and dewaxed effluent 500. Hydrotreated and dewaxed effluent 465/500 can optionally be further treated, e.g., in a stripper such as to remove gaseous contaminants (e.g., unreacted hydrogen, hydrogen sulfide, ammonia, or the like, or combinations thereof), and/or may be directly or ultimately sent to a fuel pool, such as a diesel fuel pool.

FIG. 4 shows an alternate configuration from FIG. 3. In FIG. 4, hydrocarbon feed 505 can optionally go through heat exchanger 510 (becoming heated feedstream 515) before entering hydrotreating reactor 530, where it can be combined with a hydrogen-containing treat gas stream (not shown) to contact a hydrotreating catalyst under effective hydrotreating conditions. The hydrotreated effluent from the hydrotreating reactor can be cascaded directly (without treatment) through line 535 and ultimately into the dewaxing reactor 560. Optionally, some heat from a hydrotreated and dewaxed effluent 575 can be transferred to the hydrotreated effluent in line 535 in heat exchanger 520, at which point the slightly heated hydrotreated effluent (or merely just the hydrotreated effluent, if optional heat exchanger 520 is not present) is in line 545. Hydrotreated effluent 535/545 can then flow into dewaxing reactor 560, where the left over (cascaded) unreacted hydrogen and the hydrotreated effluent can collectively contact a dewaxing catalyst under effective dewaxing conditions. Optionally, the unreacted hydrogen can be supplemented and/or augmented in the dewaxing reactor by additional hydrogen-containing treat gas stream (not shown), if desired. According to FIG. 4, the hydrotreated and dewaxed effluent can then exit the dewaxing reactor 460 through line 465 and can thereafter be subject to heater 570. Heater 570 can be a means of independent temperature control for the dewaxing reactor 560, separate from the hydrotreating reactor 530, thus resulted in a heated hydrotreated and dewaxed effluent in line 575. Optionally, as noted above, some heat from the heated hydrotreated and dewaxed effluent in line 575 can be transferred to hydrotreated effluent 535 in heat exchanger 520, thus forming slightly cooled hydrotreated and dewaxed effluent 585. Also optionally, some heat from the slightly cooled hydrotreated and dewaxed effluent in line 585 can be transferred to feed 505 in heat exchanger 510, thus forming even more cooled hydrotreated and dewaxed effluent 600. Hydrotreated and dewaxed effluent 575/585/600 can optionally be further treated, e.g., in a stripper such as to remove gaseous contaminants (e.g., unreacted hydrogen, hydrogen sulfide, ammonia, or the like, or combinations thereof), and/or may be directly or ultimately sent to a fuel pool, such as a diesel fuel pool.

ADDITIONAL EMBODIMENTS

Additionally or alternately, the invention includes the following embodiments described below.

Embodiment 1

A method for processing a hydrocarbon feedstock, comprising: mixing a hydrocarbon feed having a T5 boiling point of at least about 340° C. with a conversion stage effluent having a sulfur content of about 50 wppm or less to produce a mixed hydrocarbon feed; hydrotreating the mixed hydrocarbon feed in a hydrotreating stage by exposing the mixed hydrocarbon feed to a hydrotreating catalyst under effective hydrotreatment conditions to produce a hydrotreated effluent having a sulfur content of about 50 wppm or less; fractionating the hydrotreated effluent to produce at least a kerosene fraction having a sulfur content of about 10 wppm or less, a diesel fraction having a sulfur content of about 20 wppm or less, and a bottoms fraction; forming a bottoms feed fraction from the bottoms fraction, the bottoms feed fraction having a T5 boiling point of at least about 355° C.; and converting the bottoms feed fraction in a conversion stage by exposing the bottoms feed fraction to a dewaxing catalyst under effective conversion conditions to produce the conversion stage effluent, wherein a boiling point profile of the hydrotreated effluent corresponds to at least about 40% conversion of the hydrocarbon feed relative to a conversion threshold, the conversion threshold corresponding to the T5 boiling point of the bottoms feed fraction.

Embodiment 2

The method of embodiment 1, wherein the conversion stage effluent does not undergo separation prior to mixing with the hydrocarbon feed.

Embodiment 3

The method of embodiment 1 or embodiment 2, wherein the mixed hydrocarbon feed does not undergo separation prior to hydrotreatment.

Embodiment 4

A method for processing a hydrocarbon feedstock, comprising: exposing a bottoms feed fraction having a T5 boiling point of at least about 355° C. to a dewaxing catalyst under effective conversion conditions in a conversion stage to form a conversion stage effluent; hydrotreating the conversion stage effluent and a hydrocarbon feed having a T5 boiling point of at least about 340° C. in a hydrotreating stage by exposing the conversion stage effluent and the hydrocarbon feed to a hydrotreating catalyst in the presence of a hydrogen treat gas under effective hydrotreatment conditions to produce a hydrotreated effluent having a sulfur content of about 50 wppm or less, the conversion stage effluent including at least about 50% of the hydrogen treat gas in the hydrotreatment stage; fractionating the hydrotreated effluent to produce at least a kerosene fraction having a sulfur content of about 10 wppm or less, a diesel fraction having a sulfur content of about 20 wppm or less, and a bottoms fraction; and recycling at least about 25% of the bottoms fraction to the conversion stage as part of the bottoms feed fraction, wherein a boiling point profile of the hydrotreated effluent corresponds to at least about 40% conversion of the hydrocarbon feed relative to a conversion threshold, the conversion threshold corresponding to the T5 boiling point of the bottoms feed fraction.

Embodiment 5

The method of any one of the previous embodiments, wherein hydrogen included in the conversion stage effluent corresponds to at least about 70%, for example at least about 80%, of hydrogen introduced into the hydrotreating stage.

Embodiment 6

The method of any of the previous embodiments, wherein the hydrotreating further comprises exposing the hydrotreating feed to hydrocracking catalyst under the effective hydrotreating conditions.

Embodiment 7

The method of any one of the previous embodiments, wherein the bottoms feed fraction comprises from about 25% to about 90% of the bottoms fraction, for example from about 25% to about 75%, from about 25% to about 50%, from about 50% to about 90%, or from about 50% to about 75%.

Embodiment 8

The method of any one of the previous embodiments, wherein exposing the bottoms feed fraction to a dewaxing catalyst under effective conversion conditions comprises exposing the bottoms feed fraction to a catalyst comprising a hydrogenation metal and molecular sieve, the molecular sieve comprising ZSM-5, ZSM-23, ZSM-35, ZSM-48, zeolite Beta, or a combination thereof, for example being ZSM-23 and/or ZSM-48.

Embodiment 9

The method of embodiment 8, wherein the hydrogenation metal is selected from Pt, Pd, Pt and Pd, Ni and W, Ni and Mo, and Ni and Mo and W.

Embodiment 10

The method of any one of the previous embodiments, wherein exposing the bottoms feed fraction to a dewaxing catalyst under effective conversion conditions further comprises exposing the bottoms feed fraction to a hydrocracking catalyst under effective conversion conditions.

Embodiment 11

The method of any one of the previous embodiments, wherein the effective conversion conditions comprise a temperature from about 200° C. to about 450° C., a total pressure from about 5 barg (about 0.5 MPag) to about 300 barg (about 30 MPag), a hydrogen-containing treat gas ratio from about 100 scf/bbl (about 17 $Nm^3/m^3$) to about 5000 scf/bbl (about 840 $Nm^3/m^3$), and an LHSV from about 0.05 $hr^{-1}$ to about 10 $hr^{-1}$.

Embodiment 12

The method of any one of the previous embodiments, wherein the effective hydrotreatment conditions comprise an LHSV from about 0.3 $hr^{-1}$ to about 5.0 $hr^{-1}$, a total pressure from about 500 psig (about 3.4 MPag) to about 3000 psig (about 20.7 MPag), a hydrogen-containing treat gas ratio from about 100 scf/bbl (17 $Nm^3/m^3$) to about 5000 scf/bbl (840 $Nm^3/m^3$), and a temperature from about 500° F. (about 260° C.) to about 800° F. (about 427° C.).

Embodiment 13

The method of any one of the preceding embodiments, wherein the T5 boiling point of the bottoms feed fraction is at least about 370° C., for example at least about 380° C.

Embodiment 14

The method of any one of the preceding embodiments, wherein the boiling point profile of the hydrotreated effluent corresponds to at least about 50% conversion, for example at least about 60% conversion or at least about 70% conversion, of the hydrocarbon feed relative to the conversion threshold.

Embodiment 15

A method for processing a hydrocarbon feedstock, comprising: hydrotreating a diesel boiling range hydrocarbon feedstock having a cloud point of at least −10° C. in a hydrotreating reactor by exposing the hydrocarbon feedstock to a hydrotreating catalyst having a hydrotreating catalyst cycle length in the presence of a hydrogen treat gas under effective hydrotreatment conditions comprising a hydrotreating weight average bed temperature to produce a hydrotreated effluent having a sulfur content of about 10 wppm or less; and cascading the hydrotreated effluent directly to a dewaxing reactor, separate from the hydrotreating reactor and thus with independent temperature control therefrom, to contact a dewaxing catalyst in the presence of hydrogen under effective dewaxing conditions comprising a dewaxing weight average bed temperature to form a hydrotreated and dewaxed effluent having (i) a cloud point of at most −26° C., (ii) a cloud point at least 17° C. lower than the cloud point of the diesel boiling range hydrocarbon feedstock, or (iii) both (i) and (ii), wherein a heater is optionally included downstream of the hydrotreating reactor to independently control a temperature difference between the hydrotreating and dewaxing reactors such that the dewaxing weight average bed temperature is at least 20° C. greater (e.g., from about 28° C. to about 61° C. greater) than the hydrotreating weight average bed temperature, and wherein the hydrotreating catalyst cycle length is at least 10% longer (e.g., at least 15% longer, at least 20% longer, at least 25% longer, at least 30% longer, at least 35% longer, at least 40% longer, at least 45% longer, at least 50% longer, at least 55% longer, at least 60% longer, at least 65% longer, at least 70% longer, or at least 75% longer; additionally or alternately up to 125% longer, for example up to 100% longer, up to 95% longer, up to 90% longer, up to 85% longer, up to 80% longer, or up to 75% longer) than a comparative hydrotreating catalyst cycle length of an identical hydrotreating catalyst without independent temperature control in a single reactor along with dewaxing catalyst (or in a system with separate reactors cascaded but with temperature control in the form of a heater only upstream of the hydrotreating reactor), which system sees the identical hydrocarbon feedstock and outputs an otherwise similar, if not identical, hydrotreated and dewaxed effluent.

EXAMPLES

Example 1

Figure 2:
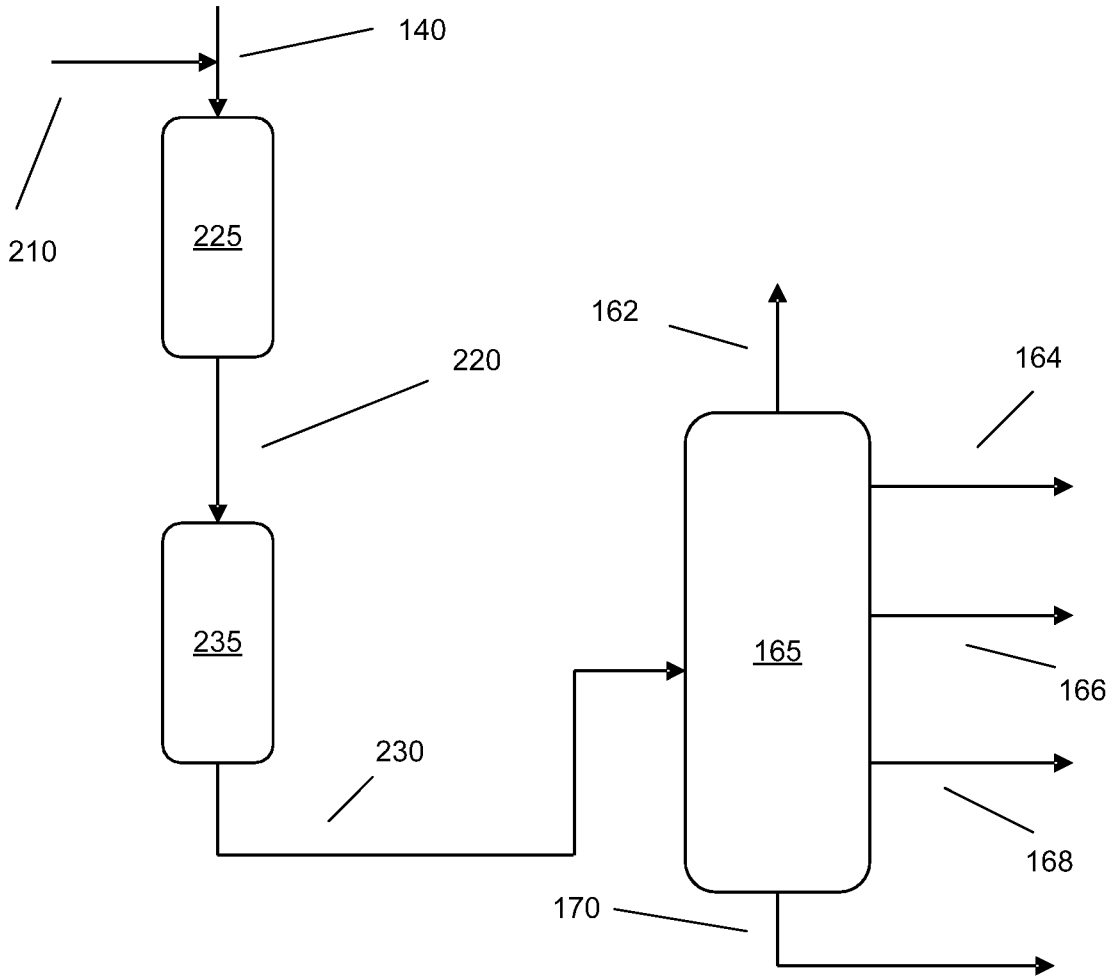
FIG. 2 depicts a comparative reaction system.

To illustrate the benefits of an embodiment of the invention, simulations were used to model the behavior of a comparative system and a system according to an embodiment of the invention. A configuration for the comparative system is shown in FIG. 2. Both the comparative system and the system according to an embodiment of the invention can represent systems with one reactor and a fractionator. The comparative system, as modeled, includes a hydrotreatment (or desulfurization) stage 225 and a conversion stage 235 in the reactor. A feedstock 210 and a hydrogen flow 140 are introduced into the hydrotreatment stage 225. The effluent 220 from the hydrotreatment stage 225 is cascaded into the conversion stage 235 without intermediate separation. The effluent 230 from the conversion stage is passed into the fractionator 165. The fractionator produces a light ends fraction 162, a naphtha fraction 164, a kerosene fraction 166, a diesel fraction 168, and a bottoms fraction 170. For the system according to an embodiment of the invention, a system similar to the configuration in FIG. 1 was modeled.

For both the comparative system and the system according to an embodiment of the invention, the conversion ratio for the combination of the desulfurization reactor and the conversion reactor was set to about 50% at about 355° C. A conventional alumina-supported NiMo hydrotreatment catalyst was modeled for both the comparative and inventive systems. For the catalysts in the conversion stage, a combination of a USY catalyst and catalyst containing ZSM-48 was modeled for both systems. The modeled ratio of USY to ZSM-48 catalyst was about 2:1. Both the modeled USY catalyst and the modeled ZSM-48 catalyst had a ratio of about 65:35 of catalyst to alumina binder. Both the modeled USY catalyst and the modeled ZSM-48 catalyst included about 0.6 wt % Pt. The same type of feed was modeled for both. Thus, the primary difference between the two systems was the order in which the feedstock passed through the stages.

Because the reaction conditions for both systems were set to achieve a similar amount of conversion, the products from the fractionators in both systems have some similarities. However, there are differences in the operating conditions, the required amounts of catalyst, and the product distribution.

Table 1 shows the properties of the feed used for this model example. These feed properties were selected to represent a typical vacuum gas oil feedstock.

TABLE 1

| | | |
|---|---|---|
| Flow Rate | $m^3$/hr | 200 |
| Specific Gravity @ 60° F. | | 0.92 |
| Total Sulfur | wt % | 3.0 |
| Total Nitrogen | wppm | 800 |
| Total Aromatics | wt % | 47 |
| Pour Point | ° C. | >25 |
| D1160 IBP | ° C. | 381 |
| D1160 5% | ° C. | 390 |
| D1160 10% | ° C. | 397 |
| D1160 30% | ° C. | 425 |
| D1160 50% | ° C. | 452 |
| D1160 70% | ° C. | 494 |
| D1160 90% | ° C. | 548 |
| D1160 95% | ° C. | 568 |
| D1160 FBP | ° C. | 586 |

Table 2 shows the catalyst requirements and operating conditions that were modeled.

TABLE 2

| | | Comparative | FIG. 1 Configuration |
|---|---|---|---|
| Raw Feed Rate | $m^3$/hr | 200 | 200 |
| Bottoms Recycled to Conversion Stage | $m^3$/hr | No | 180 |
| Total Hydrocarbon Flow to Desulfurization Stage | $m^3$/hr | 200 | 380 |
| Desulfurization Catalyst | $m^3$ | 210 | 210 |
| Conversion/Isomerization Catalyst | $m^3$ | 1000 | 280 |
| Inlet Reactor Pressure | barg (MPag) | 104.4 (10.4) | 104.4 (10.4) |
| 355° C.+ Conversion | % | 50 | 50 |
| Desulfurization Temperature | ° C. | 357 | 355 |
| HDC/Isomerization Temperature | ° C. | 359 | 338 |
| Recycle Gas Compressor Capacity (Hydrogen) | $Sm^3$/hr | 1500 | 1500 |
| Make-up Gas (Hydrogen) | $Sm^3$/hr | 350 | 303 |

As shown in Table 2, the configuration according to an embodiment of the invention provides several advantages. First, the amount of catalyst required for the conversion stage is reduced from about 1000 $m^3$ to about 280 $m^3$. The temperature for the conversion reaction is also reduced by about 21° C. This is due in part to the fact that contaminants such as sulfur and nitrogen are removed prior to reaching the conversion reaction stage. In the comparative version of a one reactor configuration, even though the desulfurization reactor has largely converted the sulfur and nitrogen into gas phase contaminants ($H_2S$ and $NH_3$), these gas phase contaminants still appear to reduce the activity of the dewaxing catalyst. Additionally in the comparative system, the entire feedstock passes through conversion reactor prior to reaching the fractionator. By contrast, in the configuration according to the invention, some feedstock passes through only the desulfurization stage and the fractionator prior to being used as a lubricant basestock. This is due, in part, to conversion of feedstock that is believed to occur during desulfurization, which can reduce the amount of dewaxing catalyst needed in the conversion stage in order to achieve the desired amount of conversion. It is noted that the flow through the desulfurization stage is increased, but this increase in flow is the already desulfurized feed that has been recycled and passed through the conversion stage. Because the additional flow has already been desulfurized, the additional flow is believed to have little or no impact on the desulfurization conditions.

Table 3 shows data for the yields of the various modeled fractions generated when the conditions for the overall reaction unit are set to about 50% conversion.

TABLE 3

| | | Comparative | FIG. 1 Configuration |
|---|---|---|---|
| $H_2$ Consumption | $Sm^3/m^3$ | 268 | 222 |
| $H_2$ Consumption | wt % | 2.46 | 2.09 |
| Hydrogen Sulfide | wt % | 3.19 | 3.19 |
| Ammonia | wt % | 0.10 | 0.10 |
| $C_1$-$C_4$ | wt % | 5.47 | 3.70 |
| $C_5$-155° C. Naphtha | wt % | 13.76 | 11.24 |
| 155° C.-280° C. kerosene | wt % | 15.32 | 15.45 |
| 280° C.-355° C. Diesel | wt % | 14.42 | 18.41 |
| 355° C.+ Bottoms | wt % | 50.21 | 50.02 |
| Total | wt % | 100.00 | 100.00 |

Table 3 shows that the inventive configuration can provide a number of advantages. The inventive configuration requires a lower amount of hydrogen to achieve a comparable level of conversion. This can be due in part to the reduced volume of feed that passes through the conversion stage. The inventive configuration also produces a lower amount of light ends and naphtha. Instead, an increased amount of kerosene and diesel are generated relative to the comparative configuration.

Table 4 shows some product characterization for the model kerosene product. As shown in Table 4, the kerosene fraction generated by the configuration according to the invention produces a kerosene with an improved smoke point, which indicates a higher quality kerosene product.

TABLE 4

| 155° C.-280° C. Kerosene | | Comparative | FIG. 1 Configuration |
|---|---|---|---|
| API Gravity | | 44.5 | 47.1 |
| Specific Gravity @ 60° F. | | 0.8041 | 0.7923 |
| Total Sulfur (Products) | ppm | <5 | <5 |
| Smoke Point | mm | 33.4 | 37.6 |
| Freeze Point | ° C. | −60 | −60 |

Table 5 shows some product characterization for the model diesel product. As shown by the cloud point data in Table 5, the diesel boiling range product produced by the configuration according to the invention is suitable for use as a diesel fuel.

TABLE 5

| 280° C.-355° C. Diesel | | Comparative | FIG. 1 Configuration |
|---|---|---|---|
| API Gravity | | 33.9 | 31.1 |
| Specific Gravity @ 60° F. | | 0.8553 | 0.8701 |
| Total Sulfur (Products) | ppm | <10 | <10 |
| Cetane Index D976-80 | | 52.8 | 49.6 |
| Cetane Index D4737 | | 61.5 | 56.8 |
| Cloud Point | C. | −40 | −25 |

Table 6 shows some product characterization for the bottoms fractions. Although the pour point is higher for the bottoms fraction from the configuration according to the invention, the fraction is suitable as a Group II lubricant basestock (or suitable for further processing as a lubricant basestock).

TABLE 6

| 355° C.+ Bottoms | | Comparative | FIG. 1 Configuration |
|---|---|---|---|
| API Gravity | | 29.9 | 30.1 |
| Specific Gravity @ 60° F. | | 0.8768 | 0.8755 |
| Total Sulfur (Products) | ppm | <50 | <50 |
| Total Aromatics | wt % | 2.3 | 1.3 |
| Total Saturates | wt % | 97.7 | 98.7 |
| Pour Point | ° C. | −35 | −10 |
| Kinematic Viscosity at 40° C. | cSt | 60.219 | 59.865 |
| Kinematic Viscosity at 100° C. | cSt | 7.916 | 7.915 |
| Viscosity Index | | 96 | 96.8 |
| SV 100° F. (SSU) | | 312 | 310 |

Example 2

To illustrate the benefits of the independent temperature control aspect of the invention, simulations were used to model the behavior of a comparative system and two systems (FIGS. 3-4) according to the invention. A configuration for the comparative system differs from the systems according to the invention in that the comparative system has temperature control for the hydrotreating reactor linked to the dewaxing reactor, i.e., is different from FIGS. 3-4 in that the heater is located upstream of the hydrotreating reactor and after the dewaxing reactor or between the hydrotreating reactor and the dewaxing reactor. Both the comparative system and the systems according to the invention can represent systems with two reactors and one heater, although it is equally possible for the comparative system to be a hydrotreating stage and a dewaxing stage successively in a single reactor, instead of in separate reactors, so long as the heater remains upstream from the hydrotreating stage.

For both the comparative and inventive systems in this Example, a simulation was run on a mixed hydrocarbon feed (listed in Table 7 below) for an operating pressure of about 1260 psig (about 8.7 MPag), a treat gas rate of about 3600 scf/bbl (about 610 $Nm^3/m^3$), a hydrotreating catalyst of alumina-supported NiMo having an LHSV of about 0.9 $hr^{-1}$, and a dewaxing catalyst of Pt-ZSM-48 having an LHSV of about 3.3 $hr^{-1}$. The simulation, based on refinery data, was used to estimate temperatures in each of the hydrotreating and dewaxing reactors in order to keep the sulfur content of the hydrotreated and dewaxed effluent (ignoring gas phase contaminants) at a maximum of 10 wppm and a cloud point of −26° C. or less and/or a cloud point reduction from the feedstock of 17° C. or more.

TABLE 7

| | | |
|---|---|---|
| API Gravity | | 30.87 |
| Specific Gravity @ 60 F. | | 0.871 |
| Bromine Number | g-Br/100 g | 3.3 |
| Total Sulfur | wt % | 1.31 |
| Total Nitrogen | ppm | 626 |
| Cloud Point | deg F. | 15 |
| Total Aromatics | wt % | 35 |
| Cetane Index D976-80 | | 45 |
| Cetane Index D4737 | | 44 |
| Kinematic Visc at 40 C. | cSt | 4.23 |
| D86 IBP | deg F. | 155 |
| D86 5% | deg F. | 300 |
| D86 10% | deg F. | 461 |
| D86 30% | deg F. | 519 |
| D86 50% | deg F. | 555 |
| D86 70% | deg F. | 578 |
| D86 90% | deg F. | 627 |
| D86 95% | deg F. | 671 |
| D86 FBP | deg F. | 710 |

Table 8 below shows the resulting temperatures from the simulation. It is noted that the temperatures indicated as "Inventive Configuration" therein are representative of both configurations in FIG. 3 and FIG. 4. "WABT" represents weight average bed temperature.

TABLE 8

| | | Inventive Configuration | | Reference Config. | |
|---|---|---|---|---|---|
| Catalyst | | HDS NiMo/ Al2O3 | Dewaxing Pt-ZSM-48 | HDS NiMo/ Al2O3 | Dewaxing Pt-ZSM-48 |
| WABT | deg F. | 672 | 749 | 721 | 749 |
| Inlet temperature | deg F. | 603 | 746 | 640 | 746 |
| Outlet temperature | deg F. | 696 | 750 | 748 | 750 |

As shown in Table 8, either inventive configuration allows a much lower hydrotreating temperature in the hydrotreating reactor than in the reference configuration, which shows improvement of the independent temperature control over the dependent temperature control configurations. Without being bound by theory, the lower weight average bed temperature in the hydrotreating reactor is believed to lead to reduced deactivation of the hydrotreating catalyst in the inventive configurations, meaning that the temperature in the hydrotreating reactor would not need to be increased as much to compensate for any catalyst deactivation, and thus an increased hydrotreating catalyst cycle length can result. Based on a fit to actual refinery data for hydrotreating catalyst, the hydrotreating catalyst cycle length in the inventive configurations can be about 60 months, compared with a hydrotreating catalyst cycle length of only about 36 months for the reference configuration. That represents about a 67% increase in hydrotreating catalyst cycle length.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A method for processing a hydrocarbon feedstock, comprising:

mixing a mineral hydrocarbon feed having a T5 boiling point of at least about 340° C. and a sulfur content of at least about 200 wppm with a dewaxed conversion stage effluent having a sulfur content of about 50 wppm or less to produce a mixed hydrocarbon feed;

hydrotreating the mixed hydrocarbon feed in a hydrotreating stage by exposing the mixed hydrocarbon feed to a hydrotreating catalyst under effective hydrotreatment conditions to produce a hydrotreated effluent having a sulfur content of about 50 wppm or less;

fractionating the hydrotreated effluent to produce at least a kerosene fraction having a sulfur content of about 10 wppm or less, a diesel fraction having a sulfur content of about 20 wppm or less, and a bottoms fraction having a T5 boiling point of at least about 355° C.;

forming a bottoms feed fraction comprising about 50% to about 90% of the bottoms fraction; and converting the bottoms feed fraction in a hydrodewaxing/conversion stage by contacting the bottoms feed fraction with a dewaxing/conversion catalyst comprising a combination of zeolite USY and zeolite ZSM-48 in the presence of hydrogen under effective dewaxing/conversion conditions to produce the dewaxed conversion stage effluent, the dewaxed conversion stage effluent being cascaded to the hydrotreating stage, wherein a boiling point profile of the hydrotreated effluent corresponds to at least about 40% conversion of the hydrocarbon feed relative to a conversion threshold corresponding to the T5 boiling point of the bottoms feed fraction.

2. The method of claim 1, wherein hydrogen included in the conversion stage effluent corresponds to at least about 70% of hydrogen introduced into the hydrotreating stage.

3. The method of claim 1, wherein the bottoms feed fraction is contacted with the dewaxing/conversion catalyst comprising a hydrogenation metal and a combination of zeolite USY and zeolite ZSM-48.

4. The method of claim 3, wherein the hydrogenation metal of the dewaxing/conversion catalyst is selected from Pt, Pd, or Pt and Pd.

5. The method of claim 1, wherein the effective conversion conditions comprise a temperature from about 200° C. to about 450° C., a total pressure from about 5 barg (about 0.5 MPag) to about 300 barg (about 30 MPag), a hydrogen-containing treat gas ratio from about 100 scf/bbl (about 17 $Nm^3/m^3$) to about 5000 scf/bbl (about 840 $Nm^3/m^3$), and an LHSV from about 0.05 $hr^{-1}$ to about 10 $hr^{-1}$, and/or wherein the effective hydrotreatment conditions comprise an LHSV from about 0.3 $hr^{-1}$ to about 5.0 $hr^{-1}$, a total pressure from about 500 psig (about 3.4 MPag) to about 3000 psig (about 20.7 MPag), a hydrogen-containing treat gas ratio from about 100 scf/bbl (17 $Nm^3/m^3$) to about 5000 scf/bbl (840 $Nm^3/m^3$), and a temperature from about 500° F. (about 260° C.) to about 800° F. (about 427° C.).

6. The method of claim 1, wherein the T5 boiling point of the bottoms feed fraction is at least about 370° C.

7. The method of claim 1, wherein the boiling point profile of the hydrotreated effluent corresponds to at least about 50% conversion of the hydrocarbon feed relative to the conversion threshold.

8. The method of claim 1 in which the hydrotreating catalyst includes a hydrogenation component selected from Ni and W, Ni and Mo, or Ni and Mo and W.

9. A method for processing a hydrocarbon feedstock, comprising:

contacting a bottoms feed fraction having a T5 boiling point of at least about 355° C. with a dewaxing/conversion catalyst comprising a combination of zeolite USY and zeolite ZSM-48 and a hydrogenation metal under effective dewaxing/conversion conditions in the presence of hydrogen in a conversion stage to form a dewaxed conversion stage effluent;

cascading the dewaxed conversion stage effluent to a hydrotreating stage;

hydrotreating a mixture of the dewaxed conversion stage effluent and a mineral hydrocarbon feed, the hydrocarbon feed having a T5 boiling point of at least about 340° C. and a sulfur content of at least about 200 wppm, in the hydrotreating stage by exposing the dewaxed conversion stage effluent and the hydrocarbon feed to a hydrotreating catalyst in the presence of a hydrogen treat gas under effective hydrotreatment conditions to produce a hydrotreated effluent having a sulfur content of about 50 wppm or less;

fractionating the hydrotreated effluent to produce at least a kerosene fraction having a sulfur content of about 10 wppm or less, a diesel fraction having a sulfur content of about 20 wppm or less, and a bottoms fraction; and recycling at least about 25% of the bottoms fraction to the conversion stage as the bottoms feed fraction, wherein a boiling point profile of the hydrotreated effluent corresponds to at least about 40% conversion of the hydrocarbon feed relative to a conversion threshold corresponding to the T5 boiling point of the bottoms feed fraction.

10. The method of claim 9, wherein the bottoms feed fraction comprises about 50% to about 90% of the bottoms fraction.

11. The method of claim 9, wherein the hydrogenation metal is selected from Pt, Pd, or Pt and Pd.

12. The method of claim 9, wherein the effective conversion conditions comprise a temperature from about 200° C. to about 450° C., a total hydrogen pressure from about 5 barg (about 0.5 MPag) to about 300 barg (about 30 MPag), a treat gas ratio from about 100 scf/bbl (about 17 $Nm^3/m^3$) to about 5000 scf/bbl (about 840 $Nm^3/m^3$), and an LHSV from about 0.05 $hr^{-1}$ to about 10 $hr^{-1}$, and/or wherein the effective hydrotreatment conditions comprise an LHSV from about 0.3 $hr^{-1}$ to about 5.0 $hr^{-1}$, a total hydrogen pressure from about 500 psig (about 3.4 MPag) to about 3000 psig (about 20.7 MPag), a treat gas ratio from about 100 scf/bbl (17 $Nm^3/m^3$) to about 5000 scf/bbl (840 $Nm^3/m^3$), and a temperature from about 500° F. (about 260° C.) to about 800° F. (about 427° C.).

13. The method of claim 9, wherein the boiling point profile of the hydrotreated effluent corresponds to at least about 50% conversion of the hydrocarbon feed relative to the conversion threshold corresponding to the T5 boiling point of the bottoms feed fraction.

14. The method of claim 9 in which the hydrotreating catalyst includes a hydrogenation component selected from Ni and W, Ni and Mo, or Ni and Mo and W.

15. A method for processing a hydrocarbon feedstock, comprising:

contacting a bottoms feed fraction having a T5 boiling point of at least about 355° C. with a dewaxing/conversion catalyst comprising a combination of zeolite USY and zeolite ZSM-48 and a hydrogenation metal under effective dewaxing/conversion conditions in the presence of hydrogen in a conversion stage to form a dewaxed conversion stage effluent, the hydrogenation metal comprising Pt, Pd, or a combination thereof;

cascading the dewaxed conversion stage effluent to a hydrotreating stage;

hydrotreating a mixture of the dewaxed conversion stage effluent and a mineral hydrocarbon feed, the hydrocarbon feed having a T5 boiling point of at least about 340° C. and a sulfur content of at least about 200 wppm, in the hydrotreating stage by exposing the dewaxed conversion stage effluent and the hydrocarbon feed to a hydrotreating catalyst in the presence of a hydrogen treat gas under effective hydrotreatment conditions to produce a hydrotreated effluent having a sulfur content of about 50 wppm or less, the hydrotreating catalyst including a hydrogenation component selected from Ni and W, Ni and Mo, or Ni and Mo and W;

fractionating the hydrotreated effluent to produce at least a kerosene fraction having a sulfur content of about 10 wppm or less, a diesel fraction having a sulfur content of about 20 wppm or less, and a bottoms fraction; and recycling at least about 25% of the bottoms fraction to the conversion stage as the bottoms feed fraction, wherein a boiling point profile of the hydrotreated effluent corresponds to at least about 40% conversion of the hydrocarbon feed relative to a conversion threshold corresponding to the T5 boiling point of the bottoms feed fraction.

* * * * *